US005121132A

United States Patent [19]

Pan et al.

[11] Patent Number: 5,121,132

[45] Date of Patent: Jun. 9, 1992

[54] INK DELIVERY SYSTEM FOR PRINTERS

[75] Inventors: Alfred I. Pan, Sunnyvale, Calif.; C. S. Chan; Conrad L. Wright, both of Boise, Id.

[73] Assignee: Hewlett-Packard Company, Palo Alto, Calif.

[21] Appl. No.: 663,276

[22] Filed: Feb. 28, 1991

Related U.S. Application Data

[63] Continuation of Ser. No. 414,893, Sep. 29, 1989, abandoned.

[51] Int. Cl.[5] ..... B41J 2/175; B41J 2/05

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,095,237 | 6/1978 | Amberntsson | 346/140 R |
| 4,158,847 | 6/1979 | Heinzl | 346/140 R |
| 4,233,610 | 11/1980 | Fischbeck | 346/140 R |
| 4,272,773 | 6/1981 | Halasz | 346/140 R |
| 4,306,245 | 12/1981 | Kasugayama | 346/140 R |
| 4,329,698 | 5/1982 | Smith | 346/140 R |
| 4,333,087 | 6/1982 | Yamaguti | 346/140 R |
| 4,514,743 | 4/1985 | Roschlein | 346/140 R |
| 4,677,447 | 6/1987 | Nielsen | 346/140 R |
| 4,719,479 | 1/1988 | Kyogoku | 346/140 R |
| 4,771,295 | 9/1988 | Baker | 346/1.1 |
| 4,929,969 | 5/1990 | Morris | 346/140 R |
| 4,931,811 | 6/1990 | Cowger | 346/140 R |

*Primary Examiner*—Joseph W. Hartary

[57] ABSTRACT

An ink delivery system for an inkjet printer includes a vented supply chamber for providing a reservoir of ink and an ink compartment which is connected to the supply chamber via a hydrophobic membrane which acts as a fluid diode for regulating the flow of ink from the supply chamber into the compartment.

18 Claims, 2 Drawing Sheets

INK DELIVERY SYSTEM FOR PRINTERS

CROSS REFERENCE TO RELATED APPLICATION

This is a continuation of copending application Ser. No. 414,893 filed on Sept. 24 1989, now abandoned.

BACKGROUND OF THE INVENTION

1. Technical Field

The present invention generally relates to printers and, more particularly, to ink supply systems for thermal inkjet printers.

2. Background Art

In thermal inkjet printers, systems must be provided for supplying ink to printing elements. Typically, the ink supply systems include ink supply chambers that act as ink reservoirs. To prevent ink from drying in the supply chambers, it is known to place sponge-like materials in the chambers to hold ink. It is also known to place collapsible bladders in supply chambers to hold ink.

There are several shortcomings in ink supply systems that are conventionally used in thermal inkjet printers. For example, sponge-like materials occupy substantial volume in ink supply chambers and, therefore, limit ink storage capacity. Moreover, the capillary-like action inherent in sponge-like materials creates back pressures that increase as ink is depleted. In some situations, back pressure may increase sufficiently to interfere with ink release in sufficient quantities to maintain high quality printing.

In view of the foregoing discussion, it can be appreciated that a need exists in the thermal inkjet printer art for systems that provide improved control of ink flow to printing elements.

SUMMARY OF THE INVENTION

Generally speaking, the present invention provides an ink delivery system for delivering ink to a printing element of a thermal inkjet printer. More particularly, the present invention comprises an ink supply chamber which provides a reservoir of ink and which is vented to the atmosphere; an ink receiving compartment mounted adjacent the supply chamber to receive ink from the supply chamber; and a hydrophobic membrane that functions as a fluid diode for regulating the flow of ink between the supply chamber and the ink compartment according to the differential between the pressure interior of the ink supply chamber and the pressure interior of the ink compartment.

In the preferred embodiment of the present invention, the fluid diode membrane is constructed of non-wettable polymer material. Examples of suitable non-wettable polymer materials include Teflon (TM) with pore diameters ranging between about ten microns and about twenty microns, and Nylon (TM) mesh having pore diameters ranging from about five microns to about twenty microns. The bubble pressure of the fluid diode membrane ranges between approximately 0.03 psi and about 5.0 psi and, typically, is about 0.2 psi. Bubble pressures near the lower limit of the range, for example, typically are associated with membranes having pore diameters of about sixteen microns. In any event, the hydrophobic membrane has flow characteristics generally as shown in FIG. 3 hereof.

BRIEF DESCRIPTION OF THE DRAWINGS

Various features, and advantages of the present invention can be appreciated from the following description in conjunction with the appended drawings, wherein like elements bear like reference numerals. In the drawings.

DETAILED DESCRIPTION OF THE PREFERRED EMBODIMENT

Figure 1:
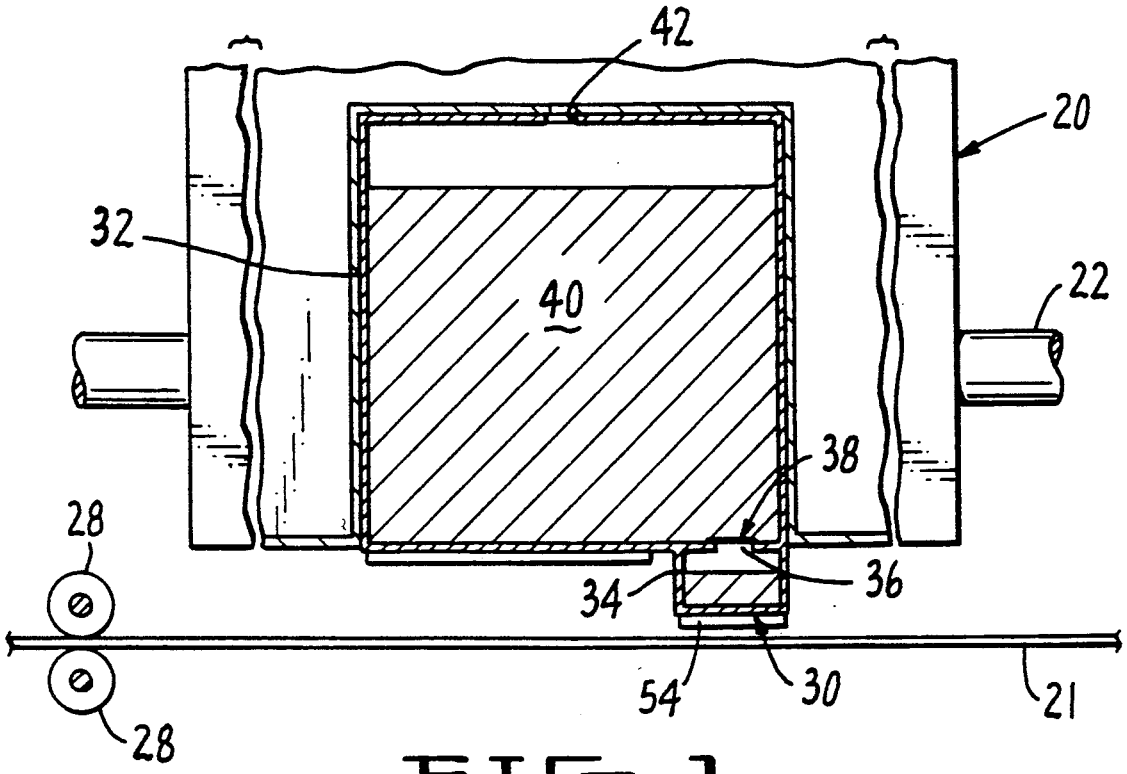
FIG. 1 is a cross-sectional view of an inkjet printing assembly according to the present invention.

FIG. 1 generally shows an inkjet pen carriage 20 that carries components, including an inkjet pen means 24, for printing a sheet 21. In the illustrated embodiment, carriage 20 is slidable on a guide shaft 22 for carrying pen means 24 back and forth parallel to the surface of sheet 21. It should be understood that a suitable motor, not shown, is connected for driving carriage 20 along guide shaft 22. Rollers 28 are provided for feeding individual sheets beneath inkjet pen means 24.

As further shown in FIG. 1, inkjet pen means 24 includes a thermal inkjet printing element, generally designated by the number 30, and a system for delivering ink to the printing element. Various suitable configurations of the printing element 30 are well known and, for that reason, the printing element is not described in detail herein. Suitable printing elements are commercially available from various sources, including the Hewlett-Packard Company of Palo Alto, Calif.

The ink delivery system in FIG. 1 includes an ink supply chamber 32 that contains a reservoir of ink 40. The size and shape of supply chamber 32 is a matter of design choice. However, whatever the shape of chamber 32, it includes a vent opening 42 that vents the interior of the chamber to the atmosphere.

Further, the ink delivery system in FIG. 1 includes an ink receiving compartment 34 to whose bottom is connected thermal inkjet printing element 30. The ink receiving compartment is connected adjacent supply chamber 32 and communicates with it via an aperture 36. A fluid diode membrane 38 is sealed across aperture 36 so that any ink entering compartment 34 passes through the membrane. As will be explained below, membrane 38 regulates the flow of ink from the supply chamber into the receiving compartment.

Figures 2A, 2B, 2C:
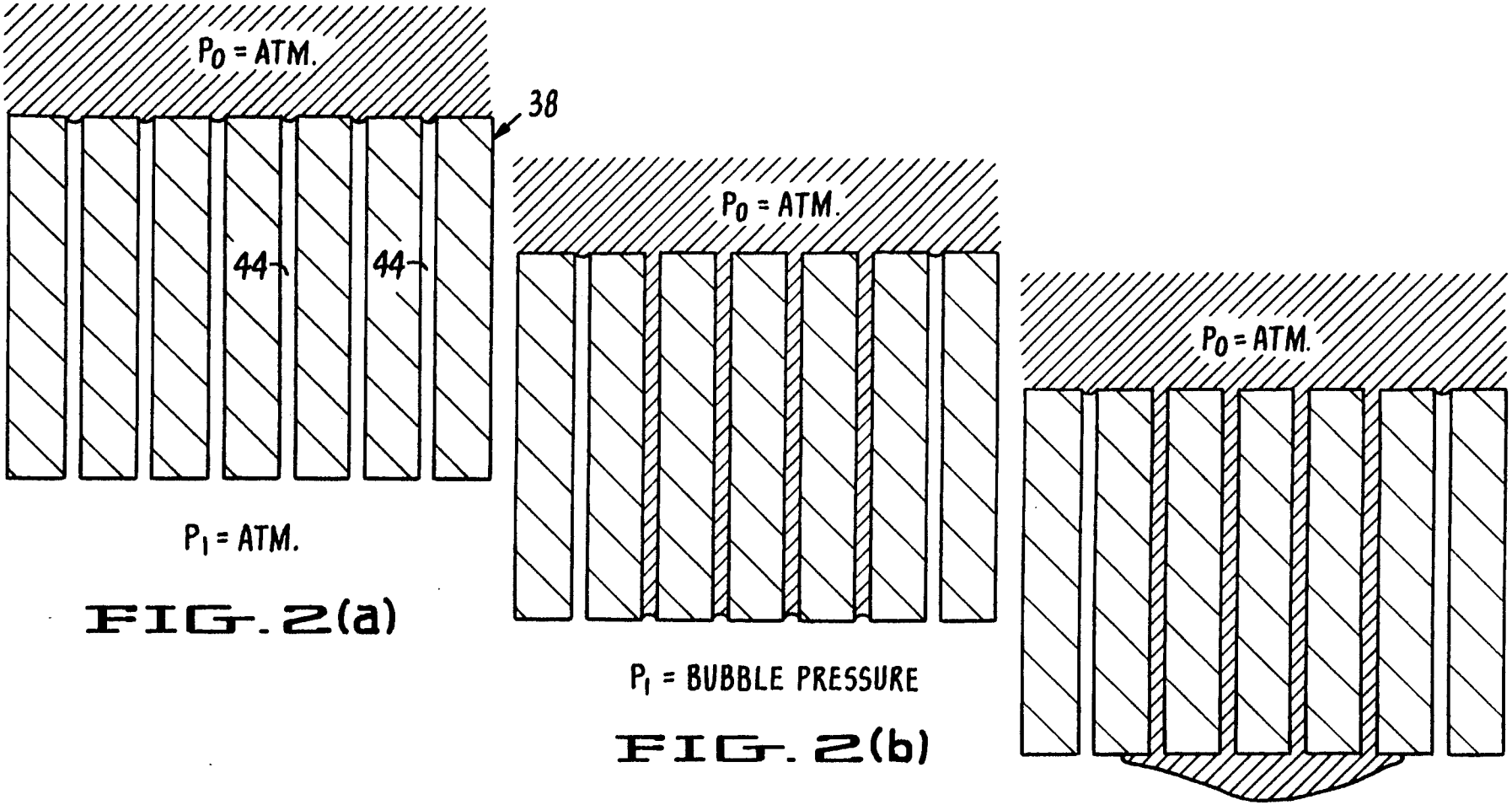
FIGS. 2(*a*), 2(*b*) and 2(*c*) are cross-sectional views, drawn to an enlarged scale, of a fluid diode membrane for use in the system of FIG. 1.

As shown clearly in FIGS. 2(*a*) through 2(*c*), fluid diode membrane 38 includes a plurality of fine pores or "capillaries" 44 of substantially uniform size. Workers skilled in the art will recognize that ink is held in such capillaries by surface tension and will not exit them unless the fluid pressure differential across the membrane exceeds a particular value, referred to as the "bubble pressure". A functional relationship between the bubble pressure of such a membrane and its physical properties is expressed by the following equation:

$$P = \frac{K4\sigma\cos\theta}{d}$$

where

P=bubble pressure $\sigma$ = surface tension $\theta$ = liquid-solid contact angle d = capillary diameter K = shape correction factor.

In practice, the bubble pressure of the fluid diode membrane can range between approximately 0.03 psi and about 5.0 psi and, typically, is about 0.2 psi. Bubble pressures near the lower limit of the range, for example, typically are associated with membranes having pore diameters of about sixteen microns.

Preferably, fluid diode membrane 38 is constructed of non-wettable (i.e., hydrophobic) polymer material. Examples of suitable hydrophobic polymers include Teflon (TM) with pore diameters ranging between about ten microns and about twenty microns, and Nylon (TM) mesh having pore diameters ranging from about five microns to about twenty microns.

Operation of the ink delivery system of FIG. 1 will now be described in conjunction with FIGS. 2 and 3. Initially, it should be understood that vent 42 in chamber 3 maintains atmospheric pressure in the chamber at all times. Also, it should be understood that sub-atmospheric pressure (i.e., negative pressure) is initially established above the ink level in supply compartment 34.

When thermal inkjet printing element 30 is operated to eject ink, the reduction in ink volume in compartment 34 increases the negative pressure below fluid diode membrane 38 and, hence, increases the fluid pressure differential across the membrane. When the point is reached at which the pressure differential exceeds the membrane's bubble pressure, ink is drawn into compartment 34 from ink supply chamber 32. The flow of ink continues until the quantity of ink within compartment 34 is increased sufficiently to reduce the pressure differential across membrane 38 to a value which is less than the bubble pressure. Accordingly, it can be said that the ink supply system is self-regulating and provides constant back pressure regardless of the quantity of ink that remains in supply chamber 32.

FIG. 2(*a*) illustrates the state of fluid diode membrane 38 before vacuum is drawn in compartment 34. Under such conditions, there is atmospheric pressure in both the ink supply chamber and in the ink compartment. Accordingly, there is no fluid pressure differential across the fluid diode membrane and, accordingly, ink does not flow through the capillaries 44 in the membrane.

FIG. 2(*b*) illustrates the state of fluid diode membrane 38 when the pressure in compartment 34 has been reduced sufficiently that the fluid pressure differential across the membrane exactly equals its bubble pressure. Under such conditions, ink fills capillaries 44 but the surface tension restrains the ink from flowing out of the membrane. Thus, FIG. 2(*b*) can be understood to show the state of the fluid diode membrane just before, or just after, ink flows across it.

FIG. 2(*c*) shows conditions when the pressure differential between ink compartment 34 and supply chamber 32 exceeds the bubble pressure of fluid diode membrane 38. This is the typical situation during normal inkjet printing, and is due to ejection of ink from thermal printing element 30. In this situation, the fluid pressure differential across membrane 38 forces ink through capillaries 44 and into compartment 34. Moreover, when the ink ejection rate is increased, the decreasing volume of ink in compartment 34 further increases the pressure differential across the membrane and, accordingly, further increases the flow rate of ink through the membrane.

Thus, it can be understood that fluid diode membrane 38 provides self regulation of ink flow from supply chamber 32 to compartment 34. When the pressure differential across the membrane exceeds its bubble pressure and ink is dispensed through printing element 30 rapidly, then ink flows through the membrane 38 relatively rapidly. On the other hand, when ink is dispensed slowly from printing element 30, ink flows slowly across the membrane. In either case, the pressure differential that is required to initiate ink flow across the membrane is independent of barometric pressure or ambient temperature.

Negative pressure can be initially established within compartment 34 by filling the compartment with ink and then, before printing, ejecting ink drops from printing element 30. When compartment 32 is initially full of ink, approximately one thousand droplets must be ejected from the compartment before the fluid pressure differential across membrane 38 equals the membrane's bubble pressure. Preferably, supply chamber 32 is transparent to permit the ink volume to be visually detected.

Figure 3:
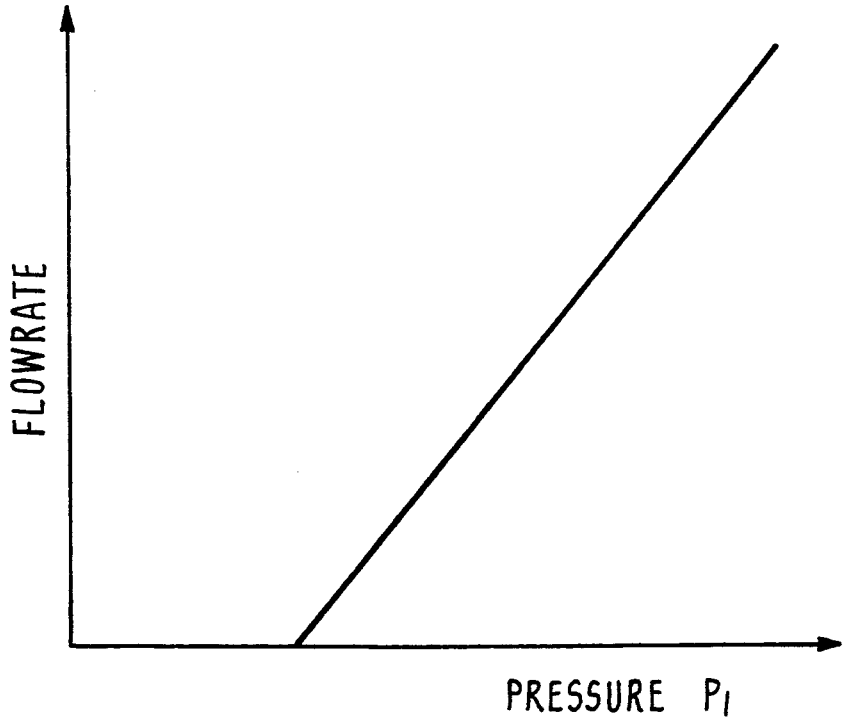
FIG. 3 is a graph which is provided to assist in explaining operation of the inkjet printing assembly of FIG. 1.

A typical example of the flow conditions across fluid diode membrane 38 are illustrated by the graph in FIG. 3. In the graph the vertical axis represents ink flow rate through the membrane, and the horizontal axis represents the fluid pressure differential across the membrane. As shown in the graph, there is no ink flow through the membrane until the pressure differential equals the membrane's bubble pressure. After the bubble pressure, P, is exceeded the flow rate through the membrane increases generally linearly with the pressure differential across the membrane. Since the flow rate behavior of the membrane is similar to the electrical current behavior of an electronic diode, the membrane is termed a "fluid diode" membrane.

The principles, preferred embodiments and modes of operation of the present invention have been described in the foregoing specification. However, the invention which is intended to be protected should not be construed as limited to the particular embodiments disclosed. That is, the embodiment described herein is to be regarded as illustrative rather than restrictive. Variations and changes may be made by others without departing from the spirit of the present invention. Accordingly, it is expressly intended that all such variations and changes which fall within the spirit and scope of the present invention as defined in the claims are embraced thereby.

What is claimed is:

1. An ink delivery system for delivering ink to a printing element of a thermal inkjet printer, comprising:

an ink supply chamber for providing a reservoir of ink;

vent means for continuously venting the ink supply chamber to the atmosphere;

an ink receiving compartment mounted adjacent to said supply chamber for receiving ink from said supply chamber;

a thin hydrophobic membrane connecting said supply chamber with said receiving compartment for regulating the flow of ink into said ink receiving compartment according to the pressure differential between the interior of said ink supply chamber and the interior of said ink receiving compartment; said hydrophobic membrane having a predetermined bubble pressure in the range of 0.03 psi and 5.0 psi and being operative to pass ink from said ink supply chamber to said ink receiving compartment when the differential pressure across said membrane exceeds the bubble pressure of said membrane; and wherein said bubble pressure, P, is defined by the equation:

$$P = \frac{K4\sigma\cos\theta}{d}$$

where

P=bubble pressure $\sigma$=surface tension $\theta$=liquid-solid contact angle d=capillary diameter K=shape correction factor, and an inkjet printing element mounted in inkflow communication with said ink receiving compartment for ejecting ink from said compartment.

2. An ink delivery system in accordance with claim 1, wherein said vent means provides an opening for air flow communication with the interior of the ink supply chamber.

3. An ink delivery system in accordance with claim 1, wherein the predetermined bubble pressure ranges from about 0.03 psi to about 5.0 psi.

4. An ink delivery system in accordance with claim 3 wherein the pores in the hydrophobic membrane range from about 0.02 to about 16 microns in diameter.

5. An ink delivery system in accordance with claim 1, wherein the hydrophobic membrane is comprised of a non-wettable polymer material.

6. An inkjet printing assembly comprising:

an inkjet pen assembly mounted for directing ink droplets, the inkjet pen assembly including:

a printing element for ejecting ink droplets;

delivery means for delivering ink to said printing element, said delivery means including a vented ink supply chamber, an ink receiving compartment connected adjacent said ink supply chamber, and a thin hydrophobic membrane for regulating ink flow into said ink receiving compartment according to the pressure differential between the interior of said ink supply chamber and the interior of said ink receiving compartment and passing ink from said ink supply chamber to said ink receiving compartment when the differential pressure across said thin hydrophobic membrane exceeds the bubble pressure of said membrane.

7. A printing assembly in accordance with claim 6, wherein the vented ink supply chamber is in air flow communication with the atmosphere.

8. A printing assembly in accordance with claim 6, wherein the bubble pressure of the hydrophobic membrane range exceeds about 0.03 psi.

9. A printing assembly in accordance with claim 6 where the hydrophobic membrane is comprised of a non-wettable polymer material.

10. A printing assembly in accordance with claim 9 wherein the pores in the hydrophobic membrane range in diameter from about 0.02 to about 16 microns.

11. A method for delivering ink to a printing element of a thermal inkjet printer, comprising the steps of:

interposing a hydrophobic membrane having a predetermined bubble pressure between an ink supply chamber and an ink receiving compartment;

establishing sub-atmospheric pressure within said ink receiving compartment while venting said supply chamber to atmospheric pressure so that a pressure differential is established across said hydrophobic membrane which exceeds its bubble pressure; and dispensing ink from said printing element onto a sheet to be printed, thereby reducing pressure in said ink compartment to maintain ink flow from said supply chamber to said ink compartment via said hydrophobic membrane when the differential pressure across said membrane exceeds said bubble pressure of said membrane and until the volume of ink passing into said ink receiving compartment once again decreases the negative pressure in said ink receiving compartment to thereby establish an equilibrium condition in said ink receiving compartment and across said membrane.

12. The method according to claim 11 wherein the hydrophobic membrane has flow characteristics generally as shown in FIG. 3 hereof.

13. A method for regulating the flow of ink between an ink reservoir of an inkjet pen and an inkjet printing element thereof which is separated from said reservoir by an ink receiving compartment, which includes mounting a thin hydrophobic membrane across an aperture at the interface of said ink reservoir and said ink receiving compartment and having a pore diameter sufficient to establish a corresponding bubble pressure across said membrane that must be overcome before said membrane can pass ink therethrough, and firing said printing element to thereby produce an increase in negative pressure in said ink receiving compartment and a corresponding change in the differential pressure across said membrane sufficient to overcome said bubble pressure of said membrane and thereby draw ink from said ink reservoir and through said membrane and into said ink receiving compartment until such time that the volume of ink drawn into said ink receiving compartment reduces the negative pressure therein and in turn reduces the differential pressure across said membrane to a value not exceeding said bubble pressure of said membrane, thereby enabling said membrane to cease supplying ink to said ink receiving compartment and to maintain an equilibrium condition in said ink receiving compartment and across said membrane.

14. An inkjet pen including, in combination:

a vented ink reservoir partially filled with ink, an inkjet printing element separated from an aperture in said vented ink reservoir by means of an ink receiving compartment, and a thin hydrophobic membrane having a predetermined pore diameter sufficient to establish a corresponding predetermined bubble pressure across said membrane so that when said printing element is fired, the firing produces a corresponding increase in differential pressure across said membrane sufficient to overcome its inherent bubble pressure and thereby enable said membrane to draw ink from said reservoir and through said membrane and into said ink receiving compartment until such time that the volume of ink drawn into said ink receiving compartment reduces the negative pressure therein and in turn reduces the differential pressure across said membrane to a value not exceeding said bubble pressure of said membrane and thereby establishing an equilibrium condition in said ink receiving compartment and across said membrane until the next firing of said printing element.

15. The inkjet pen defined in claim 14 wherein the bubble pressure of said hydrophobic membrane exceeds about 0.03 psi.

16. The inkjet pen defined in claim 14 wherein said hydrophobic membrane is comprised of a non-wettable polymer material.

17. The inkjet pen defined in claim 14 wherein the pores of said hydrophobic membrane range in diameter from about 0.02 microns to about 16 microns.

18. An inkjet pen including, in combination:

a vented ink reservoir partially filled with ink, an ink receiving compartment mounted adjacent to an aperture in said reservoir and having an inkjet printing element mounting adjacent an ink ejection surface of said compartment and operative to demand ink from a quantity of ink located within said ink receiving compartment, and hydrophobic membrane means mounted between within said aperture and between liquid ink on one side thereof and said air space on the other side thereof and responsive to an increase in differential pressure across said membrane means when said quantity of ink in said ink receiving compartment is reduced by an amount demanded by said inkjet printhead to thereby supply ink from said ink reservoir to said ink receiving compartment when said differential pressure exceeds the inherent bubble pressure of said membrane.

* * * * *